US007051743B2

(12) United States Patent
Kim et al.

(10) Patent No.: US 7,051,743 B2
(45) **Date of Patent: *May 30, 2006**

(54) APPARATUS AND METHOD FOR CLEANING SURFACES OF SEMICONDUCTOR WAFERS USING OZONE

(76) Inventors: Yong Bae Kim, 1114 Steeplechase La., Cupertino, CA (US) 95014; In Kwon Jeong, 20425 Via Paviso, #D14, Cupertino, CA (US) 95014; Jungyup Kim, 350 Elan Village La., #104, San Jose, CA (US) 95134

( * ) Notice: Subject to any disclaimer, the term of this patent is extended or adjusted under 35 U.S.C. 154(b) by 322 days.

This patent is subject to a terminal disclaimer.

(21) Appl. No.: 10/282,562

(22) Filed: Oct. 29, 2002

(65) Prior Publication Data

US 2004/0079395 A1 Apr. 29, 2004

(51) Int. Cl.
*B08B 3/00* (2006.01)

(52) U.S. Cl. ..... 134/151; 134/56 R; 134/94.1; 134/95.3; 134/102.2; 134/137; 134/144; 134/157; 134/184; 134/198; 134/902

(58) Field of Classification Search ..... 134/94.1, 134/95.3, 102.2, 137, 157, 184, 198, 144, 134/151, 56 R, 902
See application file for complete search history.

(56) References Cited

U.S. PATENT DOCUMENTS

| | | | | |
|---|---|---|---|---|
| 4,579,280 | A * | 4/1986 | von Ruhling | 239/8 |
| 5,464,480 | A | 11/1995 | Matthews | |
| 5,961,377 | A | 10/1999 | Jeong | |
| 5,975,098 | A * | 11/1999 | Yoshitani et al. | 134/148 |
| 6,290,777 | B1 | 9/2001 | Imaoka et al. | |
| 2001/0042555 | A1 | 11/2001 | Bergman et al. | |
| 2002/0035762 | A1* | 3/2002 | Okuda et al. | 15/77 |
| 2002/0066464 | A1 | 6/2002 | Bergman | |
| 2002/0108641 | A1 | 8/2002 | Lee et al. | |
| 2003/0005948 | A1* | 1/2003 | Matsuno et al. | 134/33 |

* cited by examiner

*Primary Examiner*—M. Kornakov
(74) *Attorney, Agent, or Firm*—Wilson & Ham; Thomas H. Ham

(57) ABSTRACT

An apparatus and method for cleaning surfaces of semiconductor wafers utilizes streams of gaseous material ejected from a gas nozzle structure to create depressions on or holes through a boundary layer of cleaning fluid formed on a semiconductor wafer surface to increase the amount of gaseous material that reaches the wafer surface through the boundary layer.

14 Claims, 8 Drawing Sheets

APPARATUS AND METHOD FOR CLEANING SURFACES OF SEMICONDUCTOR WAFERS USING OZONE

FIELD OF THE INVENTION

The invention relates generally to semiconductor fabrication processing, and more particularly to an apparatus and method for cleaning surfaces of semiconductor wafers.

BACKGROUND OF THE INVENTION

As semiconductor devices are aggressively scaled down, the number of photoresist masking steps used in the photolithography process has significantly increased due to various etching and/or implanting requirements. Consequently, the number of post-masking cleaning steps has also increased. After a layer of photoresist is patterned on a semiconductor wafer and then subjected to a fabrication process, such as plasma etch or ion implantation, the patterned photoresist layer must be removed without leaving photoresist residue, which may detrimentally affect the resulting semiconductor device with respect to performance and reliability.

Traditionally, semiconductor wafers have been cleaned in batches by sequentially immersing the wafers into baths of different cleaning fluids, i.e., wet benches. However, with the advent of sub-0.18 micron geometries and 300 mm wafer processing, the use of batch cleaning has increased the potential for defective semiconductor devices due to cross-contamination and residual contamination. In order to mitigate the shortcomings of batch cleaning processes, single-wafer spin-type cleaning techniques have been developed. Conventional single-wafer spin-type cleaning apparatuses typically include a single fluid deliver line to dispense one or more cleaning fluids, such as de-ionized water, standard clean 1 (SC1) solution and standard clean 2 (SC2) solution, onto a surface of a semiconductor wafer in an enclosed environment.

With respect to single-wafer spin-type techniques, it has been found that the introduction of a reactive agent in the form of a gas, such as ozone, onto a surface of a spinning semiconductor wafer in addition to a cleaning fluid, e.g., de-ionized water, has been found to be highly effective in promoting oxidization, which assists in the removal of undesired material, such as photoresist, on the semiconductor wafer surface. A conventional method for introducing ozone involves mixing the ozone with the cleaning fluid and applying the mixture to the surface of the spinning semiconductor wafer. Another conventional method involves injecting the ozone into an enclosed cleaning chamber, where the spinning semiconductor wafer is being cleaned, to create an ozone environment. In this method, the ozone environment allows ozone to be diffused through a boundary layer of a cleaning fluid formed on the semiconductor wafer surface. The diffused ozone reacts with the undesired material on the wafer surface when the diffused ozone reaches the wafer surface. The boundary layer is maintained on the spinning semiconductor wafer surface by continuous application of the cleaning fluid.

A concern with the former conventional method for introducing ozone is that the concentration of ozone in an ozone-mixed cleaning fluid is typically very low, which results in a slow oxidation rate. As an example, the concentration of ozone in ozone-mixed de-ionized water is roughly 20 ppm at room temperature. Furthermore, the concentration of ozone is inversely proportional to temperature. Thus, if the ozone-mixed deionized water is heated, which may be preferred to increase the reaction rate on the semiconductor wafer surface, the ozone-mixed deionized water will have less concentration of ozone.

With respect to the latter conventional method, a concern is that ozone decays as the ozone diffuses through the boundary layer. The rate of ozone decay is dependent on the temperature of the boundary layer and the chemicals contained in the boundary layer. The ozone decay rate increases as the temperature of the boundary layer is increased. Thus, if the boundary layer is formed of heated cleaning fluid, such as heated deionized water, then the amount of ozone that can reach the semiconductor wafer surface for oxidation will be decreased due to the increased ozone decay rate caused by the higher temperature of the boundary layer. The ozone decay rate also increases significantly in certain chemical solutions, such as $NH_4OH$, which is a highly desirable aqueous solution for cleaning semiconductor wafers. Thus, if the boundary layer is formed of $NH_4OH$, then the amount of ozone that can reach the semiconductor wafer surface will be significantly decreased due to the increased ozone decay rate caused by the presence of $NH_4OH$.

Another concern with the latter method is that a large amount of cleaning fluid and a high rotational speed of the semiconductor wafer are typically used to remove the by-products of oxidation during continuous reaction of ozone with the semiconductor wafer surface. The large amount of cleaning fluid results in a thick boundary layer, which reduces the amount of ozone that can reach the semiconductor wafer surface by diffusion. Furthermore, the high rotational speed tends to continuously push away the boundary layer containing the diffused ozone from the semiconductor wafer surface so that some of the diffused ozone does not have a chance to reach the semiconductor wafer surface for oxidation.

In view of the above-described concerns, there is a need for an apparatus and method for cleaning surfaces of semiconductor wafers using one or more cleaning fluids with reactive gaseous material, such as ozone, that can increase the amount of reactive gaseous agent that reaches the semiconductor wafer surface to promote a desired reaction, such as oxidation.

SUMMARY OF THE INVENTION

An apparatus and method for cleaning surfaces of semiconductor wafers utilizes streams of gaseous material ejected from a gas nozzle structure to create depressions on or holes through a boundary layer of cleaning fluid formed on a semiconductor wafer surface to increase the amount of gaseous material that reaches the wafer surface through the boundary layer. The depressions that are created by the streams of gaseous material reduce the thickness of the boundary layer at the depressions, which allows an increased amount of gaseous material to reach the wafer surface through the boundary layer by diffusion. The holes that are created by the streams of gaseous material allow the gaseous material to directly contact the wafer surface through the boundary layer, which results in an increased amount of gaseous material that reaches the wafer surface. As an example, streams of ozone can be used so that an increased amount of ozone can reach the semiconductor wafer surface, thereby oxidizing photoresist on the wafer surface in a more efficient manner.

An apparatus in accordance with an embodiment of the invention includes an object holding structure, a rotational drive mechanism, a fluid dispensing structure, a gas nozzle structure and a pressure controlling device. The object holding structure is configured to hold an object to be cleaned. The rotational drive mechanism is connected to the object holding structure to rotate the object holding structure and the object. The fluid dispensing structure is operatively connected to the object holding structure. The fluid dispensing structure includes at least one opening to dispense a cleaning fluid onto a surface of the object, forming a layer of cleaning fluid on the surface. The gas nozzle structure is also operatively connected to the object holding structure. The gas nozzle structure has a surface with a number of openings to eject streams of gaseous material onto different locations of the layer of cleaning fluid. The pressure controlling device is operatively connected to the gas nozzle structure to control the pressure of the streams of gaseous material, thereby affecting the thickness of the layer at the different locations.

A method of cleaning surfaces of objects in accordance with an embodiment of the invention includes the steps of rotating an object to be cleaned, forming a layer of cleaning fluid on a surface of the object, and creating depressions at different locations on the layer using streams of gaseous material, including controlling pressure of the streams of the gaseous material to control the thickness of the layer at the different locations.

A method of cleaning surfaces of objects in accordance with another embodiment of the invention includes the steps of rotating an object to be cleaned, forming a layer of cleaning fluid on a surface of the object, and creating holes through the layer using streams of gaseous material such that the surface of said object is directly contacted with the gaseous material.

Other aspects and advantages of the present invention will become apparent from the following detailed description, taken in conjunction with the accompanying drawings, illustrated by way of example of the principles of the invention.

DETAILED DESCRIPTION

Figure 1:
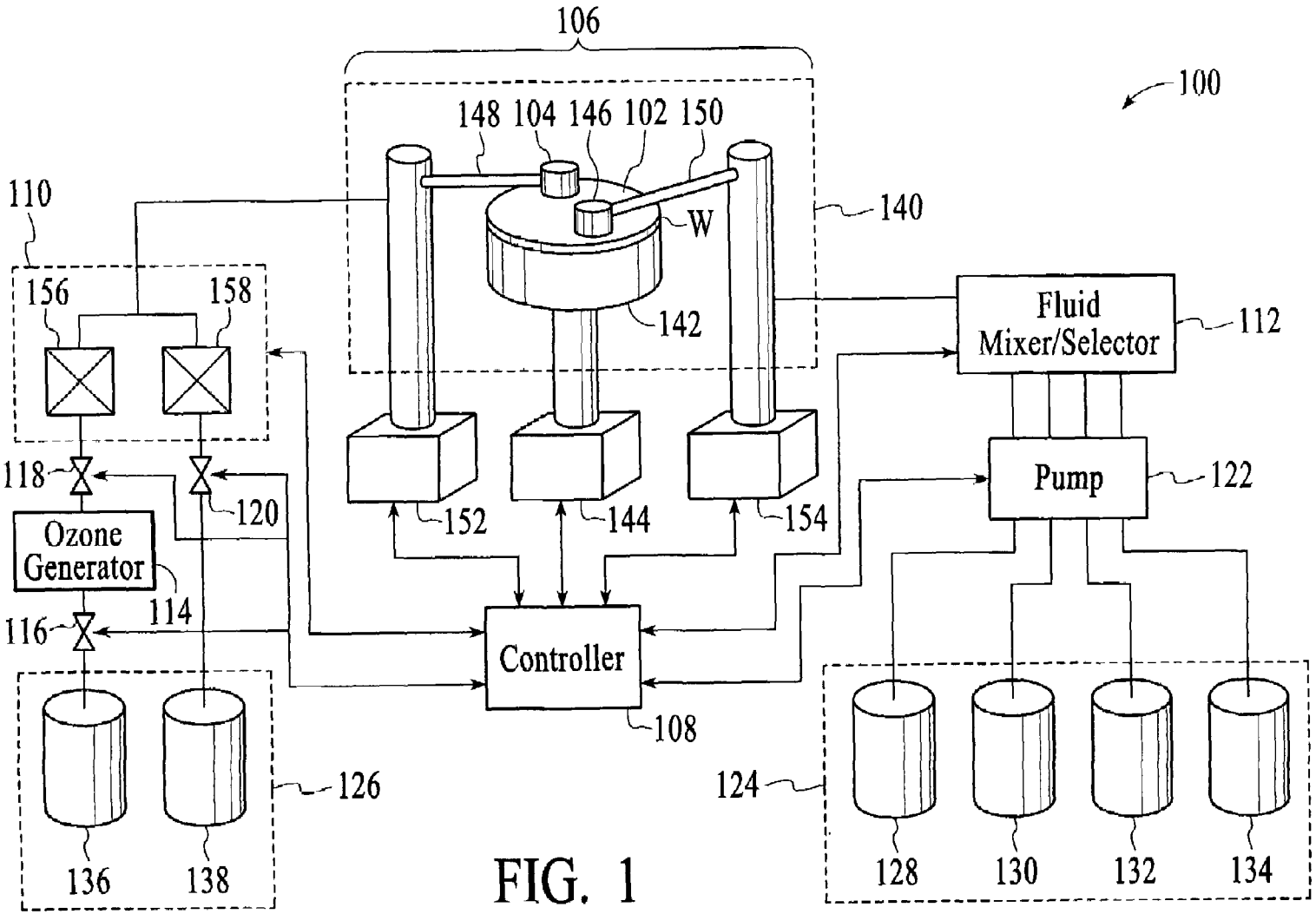
FIG. 1 is a diagram of an apparatus for cleaning a surface of a semiconductor wafer in accordance with an exemplary embodiment of the present invention.

With reference to FIG. 1, an apparatus 100 for cleaning a surface 102 of a semiconductor wafer W using a cleaning fluid in conjunction with a reactive gaseous agent, such as ozone, to remove undesired material, such as photoresist, in accordance with an exemplary embodiment of the invention is shown. The apparatus uses streams of reactive gaseous agent ejected from a gas nozzle structure 104 to increase the amount of reactive gaseous agent to reach the semiconductor wafer surface through a boundary layer of cleaning fluid formed on the wafer surface. As described in more detail below, the amount of reactive gaseous agent to reach the semiconductor wafer surface is increased either by creating depressions at different locations on the boundary layer to reduce the thickness of the boundary layer at the different locations or by creating holes through the boundary layer to directly contact the wafer surface with the reactive gaseous agent using the pressure of the streams of reactive gaseous agent. The increased amount of reactive gaseous agent to reach the semiconductor wafer surface results in more effective cleaning of the wafer surface due to increased reaction with the reactive gaseous agent, which allows the cleaning of the semiconductor wafer surface to be performed in a shorter period of time.

As shown in FIG. 1, the apparatus 100 includes a single-wafer spin-type cleaning unit 106, a controller 108, a gas pressure controlling device 110, a fluid mixer/selector 112, an ozone generator 114, valves 116, 118 and 120, a pump 122, a supply of fluids 124, and a supply of gases 126. The fluid supply 124 includes containers 128, 130, 132 and 134 to store different types of fluids, which are used by the single-wafer spin-type cleaning unit 106, as described below. Although the fluid supply 124 is shown in FIG. 1 to include four containers, the fluid supply may include fewer or more containers. The fluids stored in the containers may include the following fluids: de-ionized water, diluted HF, mixture of $NH_4OH$ and $H_2O$, standard clean 1 or "SC1" (mixture of $NH_4OH$, $H_2O_2$ and $H_2O$), standard clean 2 or "SC2" (mixture of $HC_1$, $H_2O_2$ and $H_2O$), ozonated water (de-ionized water with dissolved ozone), modified SC1 (mixture of $NH_4OH$ and $H_2O$ with ozone), modified SC2 (mixture of $HC_1$ and $H_2O$ with ozone), known cleaning solvents (e.g., a hydroxyl amine based solvent EKC265, available from EKC technology, Inc.), or any constituent of these fluids. The types of fluids stored in the containers of the fluid supply can vary depending on the particular cleaning process to be performed by the apparatus 100.

Similarly, the gas supply 126 includes containers 136 and 138 to store different types of gases, which are also used by the single-wafer spin-type cleaning unit 106, as described below. Although the gas supply 126 is shown in FIG. 1 to include two containers, the gas supply may include fewer or more containers. The gases stored in the containers may include base gases to generate reactive gaseous agents that react with undesirable material, such as photoresist, on the semiconductor wafer surface 102 to promote effective cleaning of the wafer surface. As an example, one of the containers may store oxygen ($O_2$), which is used by the ozone generator 114 to generate ozone. The generated ozone can then be applied to the semiconductor wafer surface 102 to oxidize residual photoresist on the wafer surface. Other gases that may be stored in the containers include gases that are commonly used in conventional single-wafer, spin-type, wet-cleaning apparatuses, such as $N_2$, or any gas that can be used in wafer processing, including HF vaporized gas and isopropyl alcohol (IPA) vaporized gas.

The single-wafer spin-type cleaning unit 106 includes a processing chamber 140, which provides an enclosed environment for cleaning a single semiconductor wafer, e.g., the semiconductor wafer W. The cleaning unit further includes a wafer support structure 142, a motor 144, the gas nozzle structure 104, a fluid dispensing structure 146, mechanical arms 148 and 150, and drive mechanisms 152 and 154. The wafer support structure 142 is configured to securely hold the semiconductor wafer for cleaning. The wafer support structure 142 is connected to the motor 144, which can be any rotational drive mechanism that provides rotational motion for the wafer support structure. Since the semiconductor wafer is held by the wafer support structure, the rotation of the wafer support structure also rotates the semiconductor wafer. The wafer support structure can be any wafer support structure that can securely hold a semiconductor wafer and rotate the wafer, such as conventional wafer supports structures that are currently used in commercially available single-wafer, spin-type, wet cleaning apparatuses.

Figure 2:
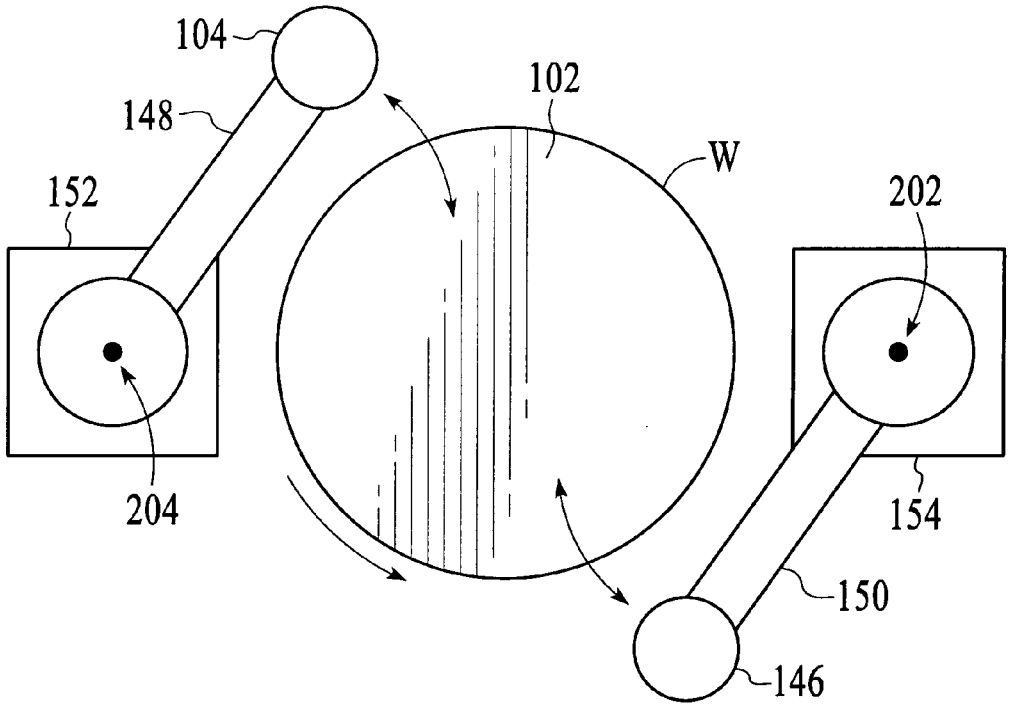
FIG. 2 is a top view of the single-wafer spin-type cleaning unit of the apparatus of FIG. 1.

The fluid dispensing structure 146 of the single-wafer spin-type cleaning unit 106 is configured to dispense a cleaning fluid onto the surface 102 of the semiconductor wafer W, which forms a boundary layer of cleaning fluid on the wafer surface. This boundary layer is just a layer of fluid formed on the wafer surface by the dispensed cleaning fluid, such as deionized water. The cleaning fluid may be one of the fluids stored in the containers 128, 130, 132 and 134 of the fluid supply 124. Alternatively, the cleaning fluid may be a solution formed by combining two or more of the fluids from the fluid supply. The fluid dispensing structure includes one or more openings (not shown) to dispense the cleaning fluid onto the semiconductor wafer surface. The fluid dispensing structure is attached to the mechanical arm 150, which is connected to the drive mechanism 154. As illustrated in FIG. 2, which is a top view of the single-wafer spin-type cleaning unit 106, the drive mechanism 154 is designed to pivot the mechanical arm 150 about an axis 202 to move the fluid dispensing structure 146 laterally or radially across the semiconductor wafer surface. The lateral movement of the fluid dispensing structure allows the cleaning fluid dispensed from the fluid dispensing structure to be applied to different areas of the semiconductor wafer surface. Preferably, the semiconductor wafer is rotated by the motor 144 as the fluid dispensing structure is laterally moved across the semiconductor wafer surface so that the applied cleaning fluid can be distributed over the entire wafer surface. The drive mechanism 154 may be further configured to manipulate the mechanical arm 150 so that the fluid dispensing structure can be moved in any number of different possible directions, including the vertical direction to adjust the distance between the fluid dispensing structure and the semiconductor wafer surface.

As shown in FIG. 1, the fluid dispensing structure 146 is connected to the fluid mixer/selector 112 to receive a cleaning fluid to be applied to the semiconductor wafer surface 102. The fluid mixer/selector operates to provide a cleaning fluid to the fluid dispensing structure by routing a selected fluid from one of the containers 128, 130, 132 and 134 of the fluid supply 124 or by combining two or more fluids from the containers of the fluid supply to produce the cleaning fluid, which is then transmitted to the fluid dispensing structure. The fluid mixer/selector is connected to each container of the fluid supply via the pump 122, which operates to pump the fluids from the containers of the fluid supply to the fluid mixer/selector.

Figure 3:
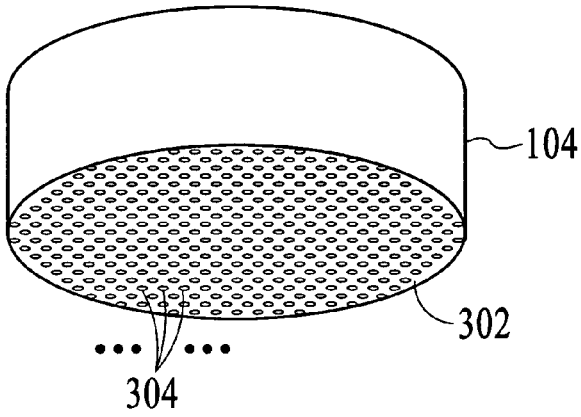
FIG. 3 is a perspective view of the gas nozzle structure of the single-wafer spin-type cleaning unit of FIG. 2.

The gas nozzle structure 104 of the single-wafer spin-type cleaning unit 106 is configured to eject streams of gaseous material onto the surface of the semiconductor wafer W. The gaseous material may be a single gas, such as ozone, or a combination of gasses. As illustrated in FIG. 3, which is a perspective view, the exemplary gas nozzle structure has a substantially planer bottom surface 302 with a number of small openings 304 for ejecting the streams of gaseous material. The gas nozzle structure is shown in FIG. 3 as being circular in shape. However, the gas nozzle structure may be configured in other shapes, such as a rectangular shape. The gas nozzle structure may be used during cleaning of the semiconductor wafer to eject streams of reactive gaseous agent onto the boundary layer of cleaning fluid formed on the semiconductor wafer surface so that the reactive gaseous agent can react with undesirable material on the semiconductor wafer surface. In addition, the gas nozzle structure may be used to eject streams of gaseous material, such as IPA vaporized gas, onto the semiconductor wafer surface after the semiconductor wafer has been cleaned and/or rinsed to dry the wafer surface.

Similar to the fluid dispensing structure 146, the gas nozzle structure 104 is attached to the mechanical arm 148, which is connected to the drive mechanism 152. The drive mechanism 152 is designed to pivot the mechanical arm 148 about an axis 204 to move the gas nozzle structure laterally or radially across the semiconductor wafer surface 102, as illustrated in FIG. 2. The lateral movement of the gas nozzle structure allows streams of gaseous material ejected from the gas nozzle structure to be applied to different areas of the semiconductor wafer surface. Preferably, the semiconductor wafer is rotated by the motor 144 as the gas nozzle structure is laterally moved across the semiconductor wafer surface so that the streams of gaseous material can be applied over the entire wafer surface. The drive mechanism 152 may be further configured to manipulate the mechanical arm 148 so that the gas nozzle structure can be moved in any number of different possible directions, including the vertical direction to adjust the distance between the openings 304 of the gas nozzle structure and the semiconductor wafer surface.

The gas nozzle structure 104 is connected to the gas pressure controlling device 110, which controls the pressure of the streams of gaseous material ejected from the gas nozzle structure. In the exemplary embodiment, the gas pressure controlling device includes mass flow controllers 156 and 158. The mass flow controller 156 controls the pressure of the ozone supplied by the ozone generator 114, while the mass flow controller 158 controls the pressure of the gas from the container 138 of the gas supply 126. As described in more detail below, the pressure of the streams of gaseous material can be adjusted by the gas pressure controlling device to reduce the thickness of the boundary layer formed on the surface 102 of the semiconductor wafer W at different locations of the boundary layer or to create holes through the boundary layer using the streams of gaseous material. The gas pressure controlling device 110 is connected to the ozone generator 114, which is connected to the container 136 of the gas supply 126. The gas pressure controlling device is also connected to the container 138 of the gas supply. The valves 116, 118 and 120 control the flow of gas between the containers 136 and 138, the ozone generator 114 and the gas pressure controlling device 110.

The controller 108 of the apparatus 100 operates to control various components of the apparatus. The controller controls the motor 144, which rotates the semiconductor wafer W via the wafer support structure 142. The controller also controls the drive mechanisms 152 and 154, which independently move the gas nozzle structure 104 and the fluid dispensing structure 146 by manipulating the mechanical arms 148 and 150. In addition, the controller controls the gas pressure controlling device 110, the fluid mixer/selector 112, the valves 116, 118 and 120, and the pump 122.

Figure 4:
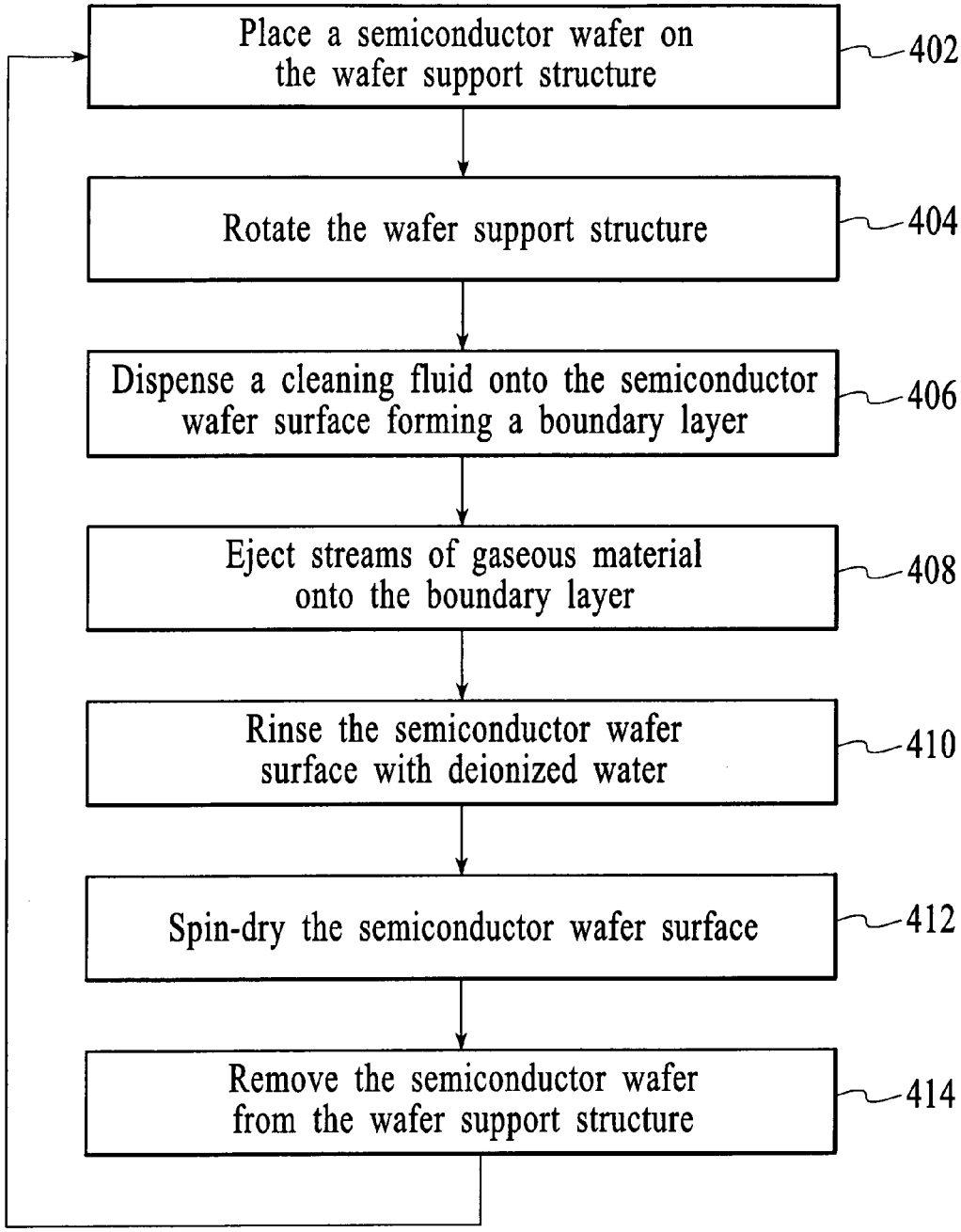
FIG. 4 is a flow diagram of an overall operation of the apparatus of FIG. 1.

The overall operation of the apparatus 100 is described with reference to the flow diagram of FIG. 4. At step 402, a semiconductor wafer to be cleaned, e.g., the semiconductor wafer W, is placed on the wafer support structure 142 of the single-wafer spin-type cleaning unit 106. Next, at step 404, the wafer support structure is rotated by the motor 144, spinning the semiconductor wafer. At step 406, a cleaning fluid is dispensed onto the semiconductor wafer surface 102 from the fluid dispensing structure 146, as the fluid dispensing structure is laterally moved across the wafer surface 102 at a predefined distance from the wafer surface. The dispensed cleaning fluid forms a boundary layer on the semiconductor wafer surface. The movement of the fluid dispensing structure is controlled by the drive mechanism 154, which manipulates the mechanical arm 150 to move the fluid dispensing structure. Next, at step 408, streams of gaseous material, such as ozone, are ejected from the gas nozzle structure 104 onto the semiconductor wafer surface at a controlled pressure, as the gas nozzle structure is laterally moved across the wafer surface at a predefined distance from the wafer surface. Due to the boundary layer formed on the semiconductor wafer surface, the streams of gaseous material ejected from the gas nozzle structure are applied to the boundary layer. The movement of the gas nozzle structure is controlled by the drive mechanism 152, which manipulates the mechanical arm 148 to move the gas nozzle structure. The pressure of the streams of gaseous material ejected from the gas nozzle structure gas is controlled by the gas pressure controlling device 110.

Figure 5:
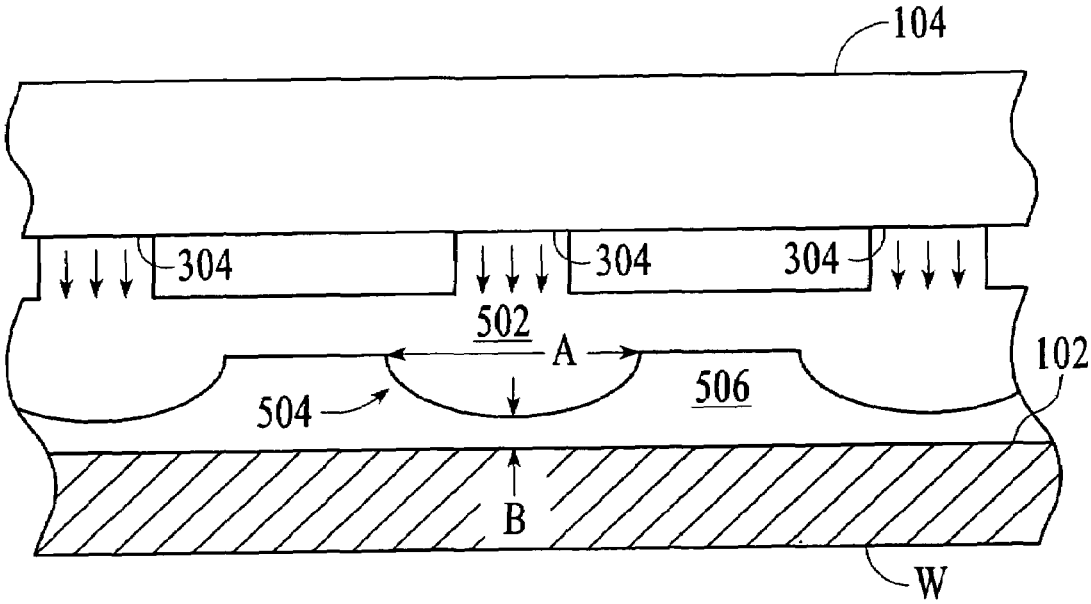
FIG. 5 is an illustration showing depressions that are made on the boundary layer by streams of gaseous material ejected from the gas nozzle structure of the single-wafer spin-type cleaning unit of FIG. 2.

In one operational mode, the pressure of the ejected streams of gaseous material is adjusted by the gas pressure controlling device 110 so that the ejected streams of gaseous material ejected from the openings 304 of the gas nozzle structure 104 reduces the thickness of the boundary layer formed on the semiconductor wafer surface 102 at different locations of the boundary layer. As illustrated in FIG. 5, in this mode, the pressure of the stream of gaseous material 502 ejected from each opening of the gas nozzle structure forms a depression 504 on the boundary layer 506. The characteristics of the depression 504 include the upper diameter A and the distance B between the lower surface of the depression and the semiconductor wafer surface 102, which is the thickness of the boundary layer at the depression. These characteristics are controlled by the pressure of the ejected stream of gaseous material, the diameter of the opening 304, the distance between the opening and the upper surface of the boundary layer 506, and the initial thickness of the boundary layer, which is determined by the wafer rotational speed and the amount (or rate) of the dispensed cleaning fluid. Where the depressions are formed, the thickness of the boundary layer is reduced, as shown in FIG. 5. Consequently, an increased amount of gaseous material reaches the semiconductor wafer surface through the boundary layer at the depressions by diffusion due to the reduced thickness of the boundary layer at the depressions. If the gaseous material is ozone, the increased amount of ozone to reach the semiconductor wafer surface through diffusion will promote more oxidation, which results in increased cleaning efficacy.

Figure 6:
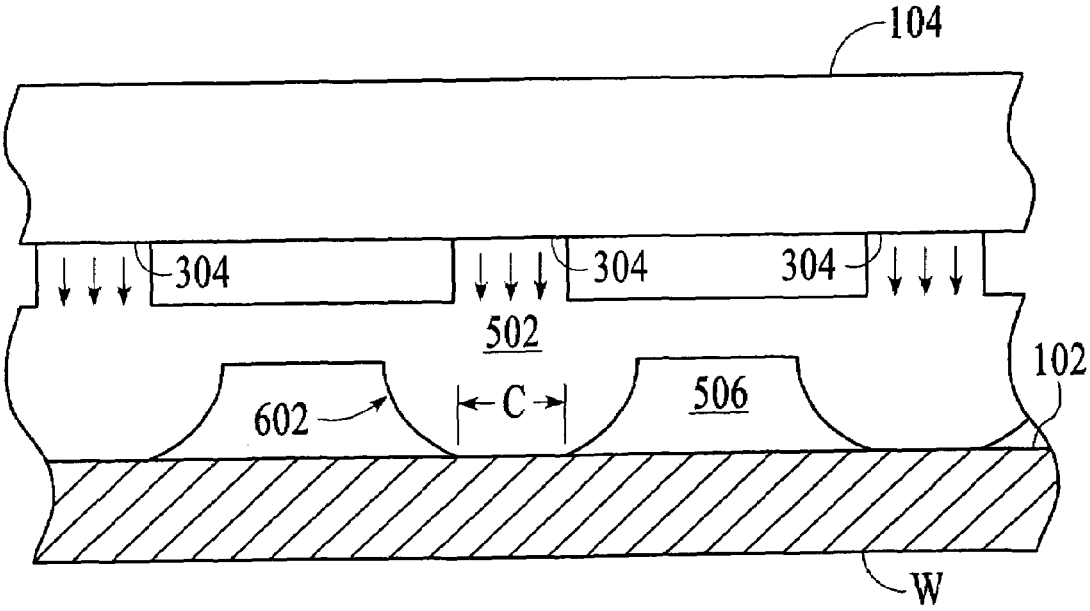
FIG. 6 is an illustration showing holes that are made through the boundary layer by streams of gaseous material ejected from the gas nozzle structure of the single-wafer spin-type cleaning unit of FIG. 2.

In another operational mode, the pressure of the ejected streams of gaseous material is adjusted by the gas pressure controlling device 110 so that the ejected streams of gaseous material from the openings 304 of the gas nozzle structure 104 can directly contact the semiconductor wafer surface 102. As illustrated in FIG. 6, in this mode, the pressure of the stream of gaseous material 502 from each opening of the gas nozzle structure creates a hole 602 through the boundary layer 506 such that the gaseous material directly contacts the semiconductor wafer surface. A characteristic of the hole 602 is the diameter C of the hole at the semiconductor wafer surface. Similar to the described depression characteristics A and B, the diameter C of the hole 602 is controlled by the pressure of the ejected stream of gaseous material, the diameter of the opening 304, the distance between the opening and the upper surface of the boundary layer 506, and the initial thickness of the boundary layer. The holes can be created by increasing the pressure of the streams of gaseous material from the gas nozzle structure and/or changing other operational parameters of the apparatus 100, such as the distance between the openings 304 of the gas nozzle structure 104 and the boundary layer 506. The streams of gaseous material from the different openings of the gas nozzle structure create an array of exposed regions on the semiconductor wafer surface that are surrounded by the cleaning fluid, i.e., the boundary layer. Since the semiconductor wafer is typically rotated, during cleaning, the exposed regions of the wafer surface continuously change as the wafer is rotated. Thus, a particular region of the semiconductor wafer surface will only be exposed to a stream of gaseous material gas for a short period of time, allowing the gaseous material to react with undesirable material on the wafer surface in the presence of the cleaning fluid. It is worth noting that for ozone, a desired oxidizing reaction with photoresist occurs only in the presence of a cleaning fluid, such as deionized water. Thus, if a large region of the semiconductor wafer surface is exposed to ozone for a long period, then the desired reaction will not take place between the ozone and the photoresist on the semiconductor wafer surface.

Turning back to FIG. 4, the operation proceeds to step 410, at which the semiconductor wafer surface 102 is rinsed with deionized water dispensed from the fluid dispensing structure 146. During this rinse cycle, the gas nozzle structure 104 may be moved away from the semiconductor wafer surface. Next, at step 412, the semiconductor wafer surface is spin-dried by rotating the semiconductor wafer at a high speed. During this spin-dry cycle, the gas nozzle structure 104 may eject streams of gaseous material, such as IPA vaporized gas, to assist in the drying of the semiconductor wafer surface. At step 414, the semiconductor wafer is removed from the wafer support structure 142. The operation then proceeds back to step 402, at which the next semiconductor wafer to be cleaned is placed on the wafer support structure. Steps 404–414 are then repeated.

Figure 7:
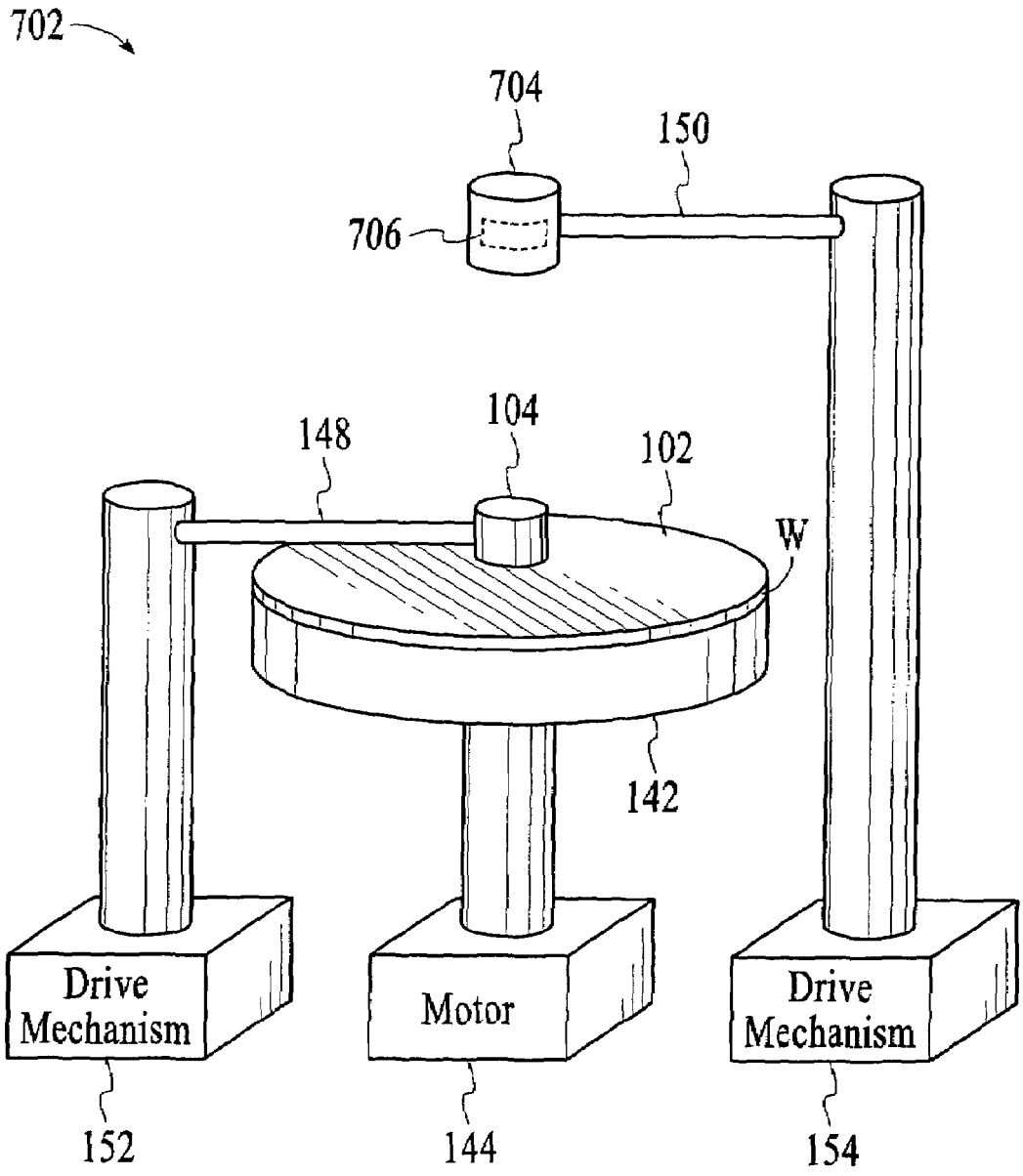
FIG. 7 is a perspective view of a single-wafer spin-type cleaning unit in accordance with a first alternative embodiment of the invention.

In other embodiments, the single-wafer spin-type cleaning unit 106 may be modified to dispense the cleaning fluid over the gas nozzle structure 104 so that the cleaning fluid and the streams of gaseous material are applied to a common area of the semiconductor wafer surface. In FIG. 7, a single-wafer spin-type cleaning unit 702 in accordance with a first alternative embodiment is shown. Same reference numerals of FIG. 1 are used to identify similar elements in FIG. 7. In this embodiment, the cleaning unit 702 includes a fluid dispensing structure 704 that is positioned over the gas nozzle structure 104. As shown in FIG. 7, the fluid dispensing structure 704 may be connected to the drive mechanism, and thus, can be moved in various directions. In an alternative configuration, the fluid dispensing structure 704 may be fixed at a predefined location so that the drive mechanism is not needed. The fluid dispensing structure 704 may include one or more small openings to spray a cleaning fluid onto the semiconductor wafer surface 102 so that the cleaning fluid is applied over the entire wafer surface in a substantially even manner. The fluid dispensing structure 704 may further include an acoustic transducer 706 to generate a fog of cleaning fluid using sonic energy, which allows the cleaning fluid to be applied more evenly over the entire semiconductor wafer surface.

Figure 8:
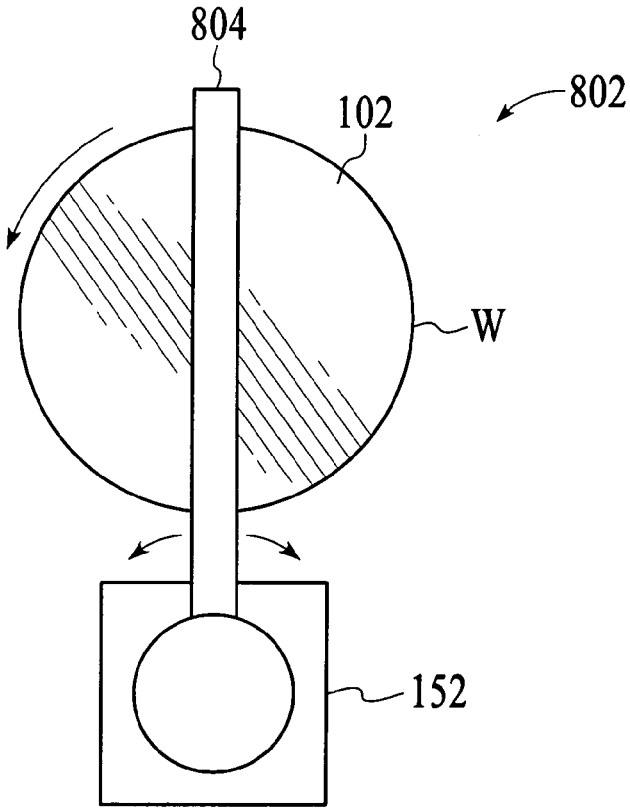
FIG. 8 is a top view of a single-wafer spin-type cleaning unit in accordance with a second alternative embodiment of the invention.
Figure 9:
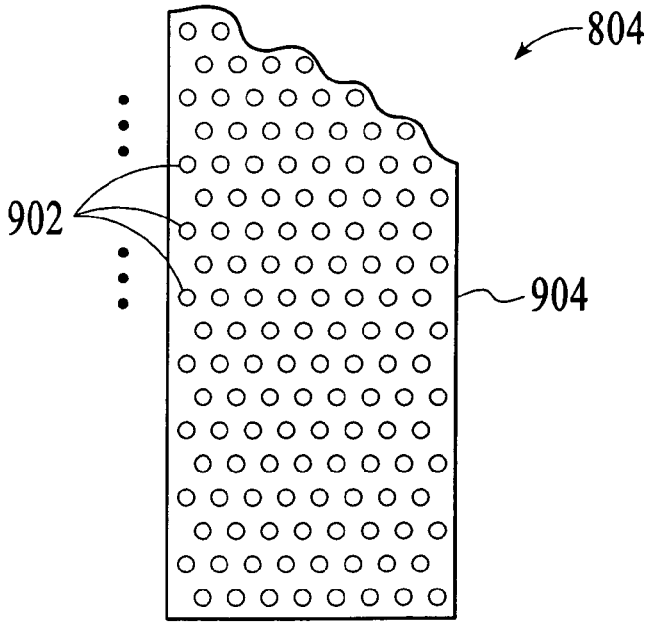
FIG. 9 is a sectional bottom view of the bar-type gas nozzle structure of the single-wafer spin-type cleaning unit of FIG. 8.

In FIG. 8, a single-wafer spin-type cleaning unit 802 in accordance with a second alternative embodiment is shown. Same reference numerals of FIGS. 1 and 7 are used to identify similar elements in FIG. 8. The cleaning unit 802 is similar to the cleaning unit 702 of FIG. 7. The main difference between the two cleaning units is that the cleaning unit 802 includes a bar-type gas nozzle structure 804, which replaces the gas nozzle structure 104 of the cleaning unit 702. The fluid dispensing structure 702, the mechanical arm 150 and the drive mechanism 154 are not shown in FIG. 8. The shape of the bar-type gas nozzle structure may be any bar-like configuration. As an example, the bar-type gas nozzle structure may be an elongated structure with a rectangular or circular cross-section. In other configurations, the bar-type gas nozzle structure may be curved. The bar-type gas nozzle structure 804 includes openings 902 on the bottom surface 904 of the structure to eject streams of gaseous material, such as ozone, as illustrated in FIG. 9. Consequently, the entire semiconductor wafer surface can be subjected to streams of gaseous material from the bar-type gas nozzle structure by a single pass of the gas nozzle structure across the wafer surface.

Figure 10:
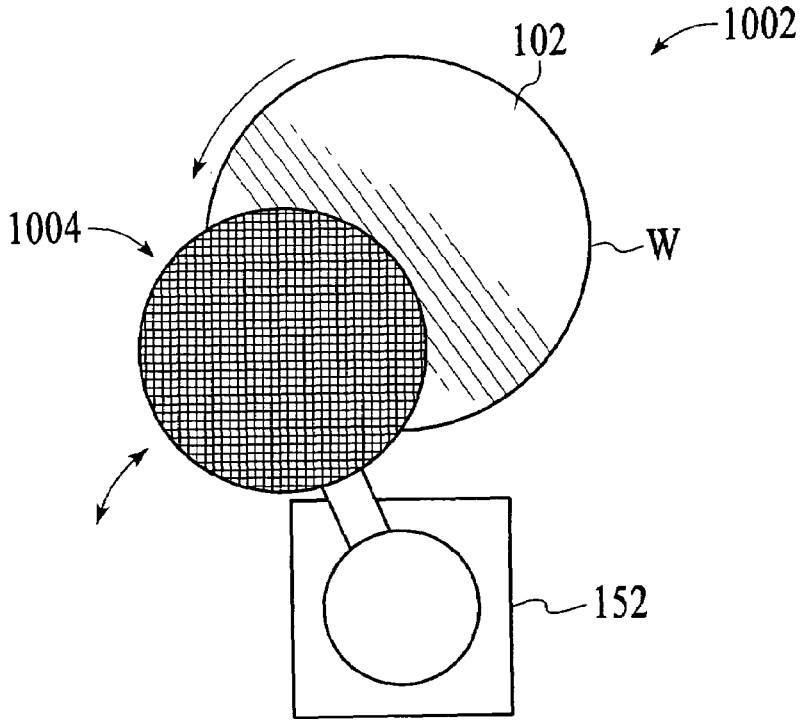
FIG. 10 is a top view of a single-wafer spin-type cleaning unit in accordance with a third alternative embodiment of the invention.
Figure 11:
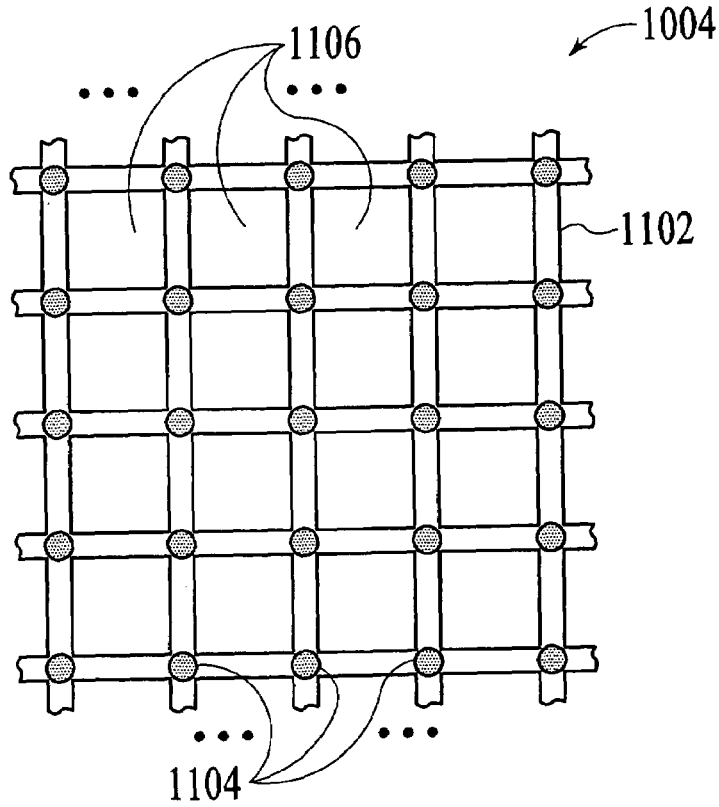
FIG. 11 is a sectional bottom view of the grid-type gas nozzle structure of the single-wafer spin-type cleaning unit of FIG. 10.

In FIG. 10, a single-wafer spin-type cleaning unit 1002 in accordance with a third alternative embodiment is shown. Same reference numerals of FIGS. 1, 7 and 8 are used to identify similar elements in FIG. 10. The single-wafer spin-type cleaning unit 1002 of FIG. 10 is similar to the single-wafer spin-type cleaning units 702 and 802 of FIGS. 7 and 8. The main difference between the cleaning unit 1002 and the cleaning units 702 and 704 is that the cleaning unit 1002 includes a grid-type gas nozzle structure 1004, rather than the gas nozzle structure 104 or the bar-type gas nozzle structure 804. As illustrated in FIG. 11, which is a bottom view, the grid-type gas nozzle structure 1004 is configured as a grid 1102 with openings 1104 to eject streams of gaseous material, such as ozone. The openings are shown to be located at the intersections of the grid 1102. However, the openings may be located at other places on the grid. Due to the grid configuration, the grid-type gas nozzle structure includes rectangular spaces 1106 that permit the dispensed cleaning fluid from the fluid dispensing structure 704, which is positioned above the grid-type gas nozzle structure, to pass through the grid-type gas nozzle structure. As stated above, the dispensed cleaning fluid from the fluid dispensing structure may be in the form of a spray or fog. Consequently, the grid-type gas nozzle structure allows both the cleaning fluid from the fluid dispensing structure and the streams of gaseous material from the grid-type gas nozzle structure to be applied on a common area of the semiconductor wafer surface 102. Although the grid-type gas nozzle structure has been described and illustrated as being a grid structure, the grid-type nozzle structure may be any grid-like structure with an array of spaces, which may be rectangular, circular or any desired shape. As an example, the grid-type gas nozzle structure may be configured as a circular disk with an array of circular spaces.

The operation of an apparatus employing the single-wafer spin-type cleaning unit 702, 802 or 1002 is similar to the operation of the apparatus 100 of FIG. 1. A significant difference is that, for the apparatus employing the single-wafer spin-type cleaning unit 702, 802 or 1002, the cleaning fluid is dispensed from the fluid dispensing structure 704 above the gas nozzle structure 104, 804 or 1104 in the form of a spray or fog, which allows the cleaning fluid and the streams of gaseous material from the gas nozzle structure to be applied to a common area of the semiconductor wafer surface.

Figure 12:
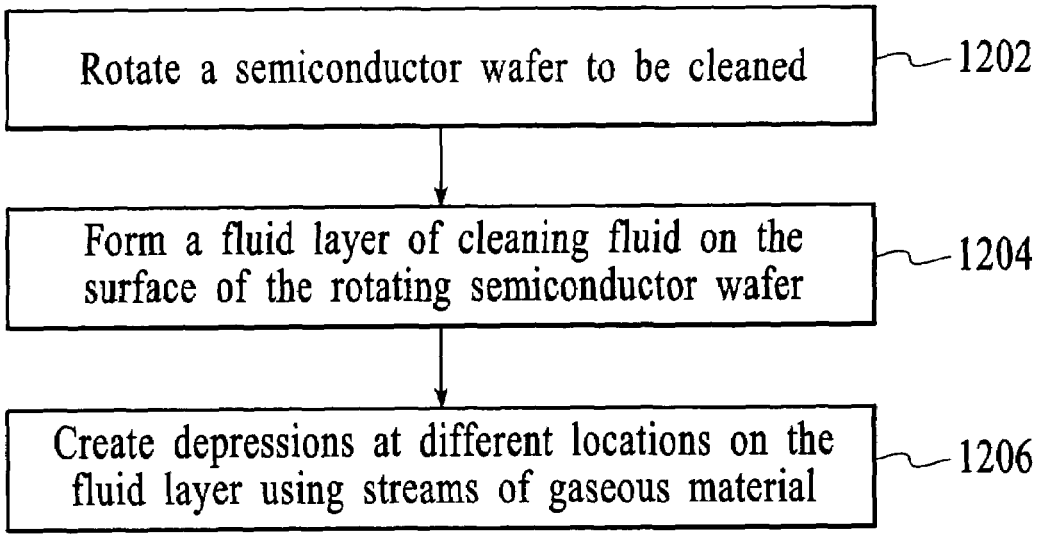
FIG. 12 is a process flow diagram of a method of cleaning a surface of a semiconductor wafer in accordance with an embodiment of the invention.

A method of cleaning a surface of a semiconductor wafer in accordance with an embodiment of the invention is described with reference to the process flow diagram of FIG. 12. At step 1202, a semiconductor wafer to be cleaned is rotated. Next, at step 1204, a fluid layer of cleaning fluid is formed on the surface of the rotating semiconductor wafer. The fluid layer may be formed by dispensing the cleaning fluid in the form of a spray or fog. At step 1206, depression at different locations on the fluid layer are created using streams of gaseous material, which may be ejected from a gas nozzle structure having a bottom surface with a number of small openings. Furthermore, at step 1206, the pressure of the streams of gaseous material is controlled to control the thickness of the fluid layer at the different locations of the fluid layer. The reduced thickness of the fluid layer at the different locations of the fluid layer due to the depressions allows an increased amount of the gaseous material, such as ozone, to reach the semiconductor wafer surface through diffusion to react with undesirable material, such as photoresist, on the wafer surface.

Figure 13:
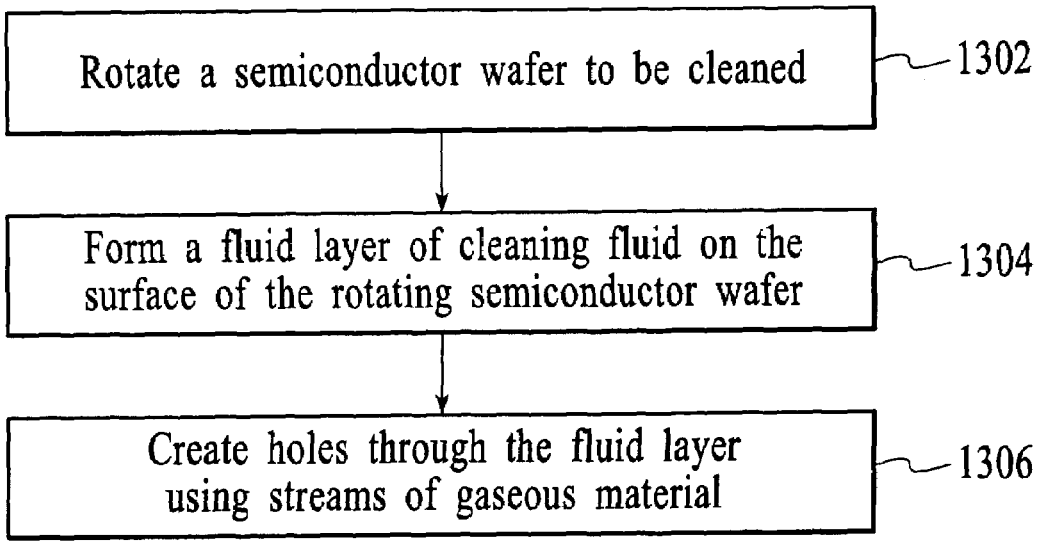
FIG. 13 is a process flow diagram of a method of cleaning a surface of a semiconductor wafer in accordance with another embodiment of the invention.

A method of cleaning a surface of a semiconductor wafer in accordance with another embodiment of the invention is described with reference to the process flow diagram of FIG. 13. At step 1302, a semiconductor wafer to be cleaned is rotated. Next, at step 1304, a fluid layer of cleaning fluid is formed on the surface of the rotated semiconductor wafer. Again, the fluid layer may be formed by dispensing the cleaning fluid in the form of a spray or fog. At step 1306, holes through the fluid layer are created using streams of gaseous material, which may be ejected from a gas nozzle structure having a bottom surface with a number of small openings. The holes allow the gaseous material, such as ozone, to directly contact undesirable material, such as photoresist, on the semiconductor wafer surface.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An apparatus for cleaning surfaces of objects comprising:

an object holding structure configured to hold an object;

a rotational drive mechanism connected to the object holding structure to rotate the object holding structure and the object;

a fluid dispensing structure operatively coupled to said object holding structure, said fluid dispensing structure including at least one opening to dispense a cleaning fluid onto a surface of said object, said cleaning fluid forming a layer of said cleaning fluid on said surface;

a gas nozzle structure operatively coupled to said object holding structure, said gas nozzle structure having a surface with a plurality of openings to eject streams of gaseous material onto different locations of said layer, wherein said fluid dispensing structure is positioned with respect to said gas nozzle structure such that said gas nozzle structure is situated between said fluid dispensing structure and said object;

a mechanical arm connected to said gas nozzle structure, said mechanical arm being configured to move said gas nozzle structure laterally across said surface of said object; and a pressure controlling device operatively connected to said gas nozzle structure to control pressure of said streams of said gaseous material ejected from said openings of said gas nozzle structure, thereby affecting thickness of said layer at said different locations.

2. The apparatus of claim 1 wherein said pressure controlling device is configured to adjust said pressure of said streams of said gaseous material such that a plurality of holes in said layer are created by said streams of said gaseous material.

3. The apparatus of claim 1 further comprising a second mechanical arm connected to said fluid dispensing structure, said second mechanical arm being configured to move said fluid dispensing structure laterally across said surface of said object.

4. The apparatus of claim 1 wherein said gas nozzle structure is shaped in a bar-like configuration.

5. The apparatus of claim 1 wherein said gas nozzle structure includes a grid-like portion with a plurality of spaces, said spaces of said grid-like portion allowing said cleaning fluid dispensed from said fluid dispensing structure to pass through said gas nozzle structure.

6. The apparatus of claim 1 wherein said fluid dispensing structure is configured to dispense said cleaning fluid in the form of a spray onto said surface of said object.

7. The apparatus of claim 1 wherein said fluid dispensing structure includes an acoustic transducer configured to generate sonic energy, said sonic energy being used to dispense said cleaning fluid in the form of a fog onto said surface of said object.

8. An apparatus for cleaning surfaces of objects comprising:

an object holding structure configured to hold an object;

a rotational drive mechanism connected to the object holding structure to rotate the object holding structure and the object;

a fluid dispensing structure operatively coupled to said object holding structure, said fluid dispensing structure including at least one opening to dispense a cleaning fluid onto a surface of said object, said cleaning fluid forming a layer of said cleaning fluid on said surface;

a gas nozzle structure operatively coupled to said object holding structure, said gas nozzle structure having a surface with a plurality of openings to eject streams of gaseous material onto different locations of said layer, wherein said fluid dispensing structure is positioned with respect to said gas nozzle structure such that said gas nozzle structure is situated between said fluid dispensing structure and said object; and a pressure controlling device operatively connected to said gas nozzle structure to control pressure of said streams of said gaseous material ejected from said openings of said gas nozzle structure, thereby affecting thickness of said layer at said different locations.

9. The apparatus of claim 8 further comprising a mechanical arm connected to said gas nozzle structure, said mechanical arm being configured to move said gas nozzle structure laterally across said surface of said object.

10. The apparatus of claim 9 further comprising a second mechanical arm connected to said fluid dispensing structure, said second mechanical arm being configured to move said fluid dispensing structure laterally across said surface of said object.

11. The apparatus of claim 8 further comprising a controller operatively connected to said pressure controlling device, said controller being configured to control said pressure controlling device so that said streams of said gaseous material produce at least depressions on said layer of cleaning fluid at said different locations.

12. The apparatus of claim 11 wherein said controller is configured to control said pressure controlling device so that said streams of said gaseous material produce holes through said layer of cleaning fluid at said different locations.

13. The apparatus of claim 11 further comprising an ozone generator operatively connected to said pressure controlling device and said controller, said ozone generator being configured to generate ozone gas, and wherein said controller is configured to control said pressure controlling device so that said gas nozzle structure ejects said streams of said gaseous material in which said gaseous material consists of said ozone gas.

14. The apparatus of claim 11 further comprising an ozone generator operatively connected to said pressure controlling device and said controller, said ozone generator being configured to generate ozone gas, and wherein said controller is configured to control said pressure controlling device so that said gas nozzle structure ejects said streams of said gaseous material in which said gaseous material consists of said ozone gas and at least one other gas selected from a group consisting of nitrogen gas, HF vaporized gas and IPA vaporized gas.

* * * * *